United States Patent [19]

Stolz

[11] 4,049,163

[45] Sept. 20, 1977

[54] CLOTHES-HANGING CLIP

[76] Inventor: Gerhard Stolz, Hanfelderstrasse 317, 8130 Starnberg, Germany

[21] Appl. No.: 706,213

[22] Filed: July 19, 1976

[51] Int. Cl.[2] ..... A47J 51/14

[52] U.S. Cl. ..... 223/96; 211/89

[58] Field of Search ..... 223/91, 96, 85; 211/89, 211/113; 24/137 A, 255 G; 248/205 A

[56] References Cited

U.S. PATENT DOCUMENTS

| | | | |
|---|---|---|---|
| 2,163,295 | 6/1939 | Subick | 223/96 |
| 2,408,344 | 9/1946 | Scurrah | 223/91 |
| 2,748,953 | 6/1956 | Behlefeldt | 223/96 X |
| 2,926,791 | 3/1960 | Hartley | 223/96 X |
| 3,101,185 | 8/1963 | Gustafson | 211/89 X |
| 3,244,334 | 4/1966 | Marlar | 223/91 |
| 3,713,614 | 1/1973 | Taylor | 248/205 A |

FOREIGN PATENT DOCUMENTS

| | | | |
|---|---|---|---|
| 594,181 | 11/1947 | United Kingdom | 223/96 |

*Primary Examiner*—George H. Krizmanich
*Attorney, Agent, or Firm*—Michael J. Striker

[57] ABSTRACT

A clothes-hanging clip has a main part adapted to be screwed or adhesively secured to a wall and a front part pivoted on the main part about a horizontal axis. The main part is formed with a pair of forwardly directed ridges each having a central notch and the pivotal part has a similar such pair of ridges engageable with the ridges of the main part to hold a pair of trouser cuffs with the seams in the notch. In addition each of the parts is formed below the ridges with a surface inclined downwardly away from the other part so as to form a downwardly widening throat into which the trouser cuffs can be forced. The main part is provided with a peg below its ridges at its lowermost end for holding up a hanger on which a jacket or shirt can be held.

10 Claims, 1 Drawing Figure

CLOTHES-HANGING CLIP

BACKGROUND OF THE INVENTION

The present invention relates to a clotheshanging clip. More particularly this invention concerns a clip for holding a pair of trousers.

It is known to hang up a pair of trousers and a jacket or shirt on a hanger provided with a pair of elements between which the cuffs of a pair of trousers can be clipped. This allows, for instance, an entire suit to be hung up on a single hanger, thereby minimizing the amount of closet space taken up and simultaneously allowing an entire matched suit of clothes to be kept together.

It is also known to hang up a pair of trousers on a clip which has a pair of jaws that can be moved apart so as to grip the trouser cuffs. There is provided in this clip a spring which is effective, toggle-fashion, to hold the jaws apart or together on either side of a central metastable position. Such an arrangement has the considerable difficulty that it is difficult to insert the cuffs of the trousers in the clip while simultaneously actuating the locking mechanism. Furthermore, when the trousers have a bulky seam they are only gripped at the seam by the clip so that the trousers become creased after some hanging, since they are only supported at the center of each cuff.

Prior-art clips can be seen in German Pat. No. 1,961,243 and in German published specification No. 2,337,644.

SUMMARY OF THE INVENTION

It is therefore an object of the present invention to provide an improved clothes-hanging clip.

Another object is the provision of such a clip which can hold a pair of trousers neatly by the cuffs and also hold a jacket and/or a shirt.

Yet another object is the provision of such an arrangement which takes up very little space, yet which holds the trousers securely by the cuff so that the trousers can hang wrinkle-free.

Yet another object is to provide such an arrangement which can be made at relatively small cost, yet which has a long service life.

These objects are attained according to the present invention in a clothes-hanging clip having a main part which is securable on a vertical surface and a pivotal part pivotal about a horizontal pivot axis on the main part. A spring is braced between these parts so as to urge the lower portions of the parts toward each other and the upper portions away from each other. A horizontally extending ridge is formed on each of the lower portions of each of the parts and has a central notch. Each of these ridges is engageable against the corresponding ridge of the other part with the notches aligned. Furthermore, each of the parts is formed below the respective ridge with a formation forming with the formation of the other part a downwardly widening throat. Thus it is possible to hold the aligned trouser cuffs in two hands and force them into the throat between the two parts so as to push these parts apart and cause them to grip the trouser cuffs with the ridges. The notch is able to receive the wider seam portion of each of the cuffs so that wrinkles will not be formed in the trousers as a result of being hung from the clip.

According to further features of this invention the spring is a compression spring braced between blind bores formed in the upper portions of the two parts. Furthermore each of the lower portions is formed with a pair of such ridges each having a respective notch.

The throat-forming formation is constituted by a flat surface on each of the lower portions of each of the parts that is inclined downwardly away from the corresponding flat surface of the other part.

According to another feature of this invention the clip is provided on the lowermost end of its main part with a peg adapted to hold up a hanger. This peg may be upwardly arcuately convex and formed with an upwardly open groove so that the hook of a hanger may seat itself securely in the groove. Thus it is possible to hang a jacket up on the main part, and then fit the trousers into the clip. Furthermore, the upper portion of the pivotal part may be formed as an upwardly curved surface that readily acts as a hanger for a shirt or tie.

The main part according to another feature of this invention is provided at its uppermost end with a hook that can engage over a clothes rod in a closet, or over a suitable peg or nail in the wall. Furthermore, the main part may be formed with through-going holes constituting the means for securing to a wall or may be formed with portions covered with a contact adhesive and a tear strip or cover sheet so that the cover sheet can be removed and the device can be adhesively secured to a vertical surface.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

SPECIFIC DESCRIPTION OF A PREFERRED EMBODIMENT

Figure 1:
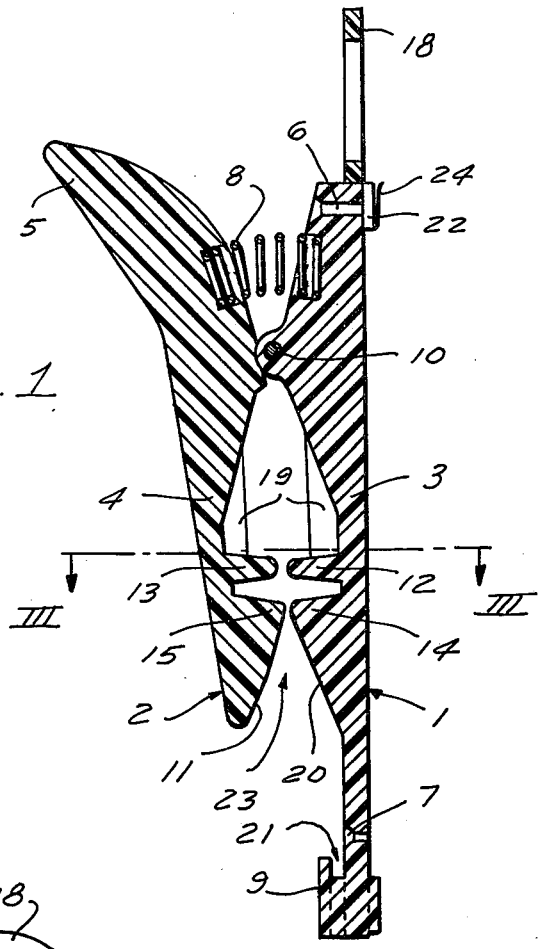
FIG. 1 is a vertical section through a clip according to this invention.
Figure 2:
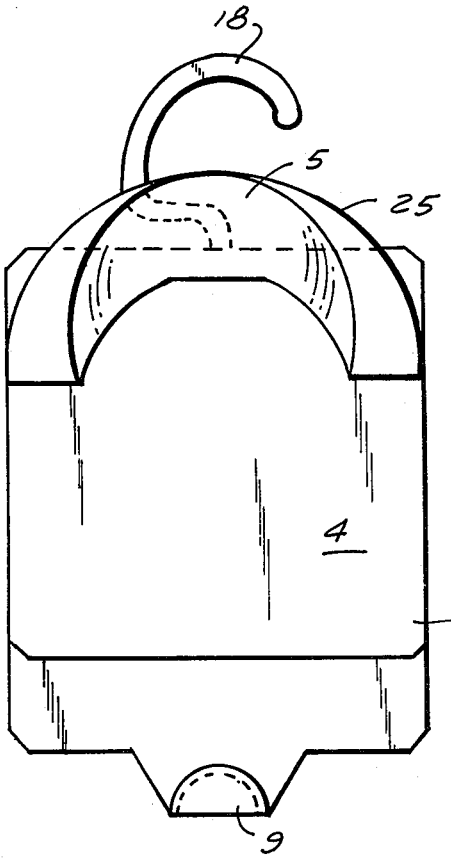
FIG. 2 is a front view of the clip shown in FIG. 1.

As shown in FIGS. 1 and 2 a clip according to the present invention has a main part 1 and a pivotal part 2. A metal pivot shaft or hinge 10 defines a horizontal pivot axis interconnecting the two and a spring 8 seated in blind bores in the upper portions of the two elements 1 and 2 serves to urge these upper portions apart and urge lower portions 3 and 4 together.

The part 1 is formed with throughgoing holes 6 and 7 at its upper and lower portions that allow screws to secure this part 1 to a vertical surface such as a wall. In addition small portions of contact adhesive 22 having cover sheets 24 are provided at least at the upper portion of the main part for securing it to a wall either permanently or at least temporarily while the screws are being fitted through the holes 6 and 7. A hook 18 at the uppermost end of the back or main part 1 allows the entire clip to be hooked over a clothes pole of a closet or onto a hook or nail in the wall.

The main part 1 is formed at the lowermost end of its lower portion 3 with a peg 9 of part-cylindrical shape that is formed with an upwardly opening groove 21 in which the hook of a conventional hanger may be received.

The pivotal portion 2 is formed at its upper end 5 with a rounded surface 25 that readily receives a shirt collar or tie so that the clip can virtually carry an entire suit of clothing.

Figure 3:
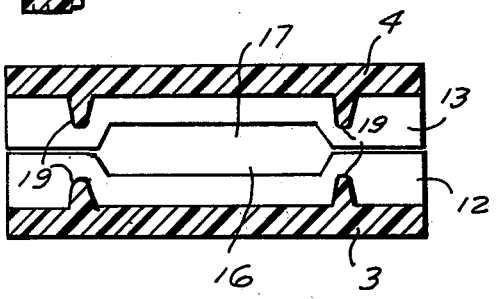
FIG. 3 is a section taken along line III-III of FIG. 1.

The lower portions 3 and 4 are formed with ridges 12, 13, 14, and 15. The ridges 12 and 14 lie directly across from the ridges 13 and 15 and extend horizontally. In addition, as shown in FIG. 3, the ridges 12 and 13, like the ridges 14 and 15, are formed with central notches 16 and 17 that receive the seam of trouser cuffs so that the outermost portions of these ridges 12-15 can snugly grip the edges of the trouser cuffs. In addition the lower portions 3 and 4 are formed below the lowermost ridges 14 and 15 with surfaces 20 and 11, respectively, which define a downwardly widening throat 23. It is possible therefore to align the cuffs of a pair of trousers and force them up into the downwardly flared throat 23 in order to cam the lower portions 3 and 4 apart and fit the trouser cuffs between the ridges 12–15.

The parts 1 and 2 are made completely of syntheticresin material and are formed with vertically extending reinforcement ridges 19.

In use it is possible for a user to hang a shirt or jacket on a hanger in the notch 21. Then the cuffs of a pair of trousers can be forced into the throat 23 between the ridges 12 and 14 on one side and 13 and 15 on the other so as tightly to grasp these cuffs. Thereupon the shirt or tie may be hung over the upper portion 5, so that an entire suit of clothing can be suspended from the clip. It is possible to remove the trousers from between the jaws formed by the parts 1 and 2 either simply by yanking them out, or by pushing the part 5 toward the wall so as to separate the ridges 13 and 15 from the ridges 12 and 14.

It will be understood that each of the elements described above, or two or more together, may also find a useful application in other types of structure differing from the types described above.

While the invention has been illustrated and described as embodied in a clothes-hanging clip, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapted it for various applications without omitting features that, from the standpoint of prior art, fairly constitute essential characteristics of the generic or specific aspects of this invention.

What is claimed as new and desired to be protected by Letters Patent is set forth in the appended claims:

1. A clothes-hanging clip comprising:
- a main part having an upper portion and a lower portion;
- means for securing said main part on a vertical surface with said upper portion above said lower portion;
- a pivotal part having an upper portion and a lower portion respectively adjacent the upper and lower portions of said main part;
- a pivot having a horizontal pivot axis between said portions and interconnecting said parts, whereby said pivotal part can pivot about said axis relative to said main part;
- a spring braced between said parts and urging said lower portions toward each other;
- a horizontally extending ridge on each of said lower portions formed with a central seam-receiving notch and engageable against the corresponding ridge of the other lower portion;
- and a flat surface on each of said lower portions below the respective ridge inclined downwardly away from the other lower portion and forming with the flat surface of the other lower portion a downwardly widening V-shaped throat.

2. The clip defined in claim 1 wherein each of said lower portions is formed with a pair of such ridges parallel to each other and each formed with a respective central notch.

3. The clip defined in claim 1, further comprising on said lower portion of said main part a peg adapted to support a hanger hook.

4. The clip defined in claim 3 wherein said peg is upwardly arcuately convex and is formed with an upwardly open groove.

5. The clip defined in claim 1, further comprising a hook at the uppermost end of said upper portion of said main part.

6. The clip defined in claim 1 wherein said main part is formed with throughgoing holes adapted to receive shanks of screws and constituting said means.

7. The clip defined in claim 1 wherein said main part is provided on its side turned away from said pivotal part with portions covered with contact adhesive and with removable cover sheets constituting said means.

8. The clip defined in claim 1 wherein each of said parts is formed with vertically extending reinforcing ribs.

9. The clip defined in claim 1 wherein each of said parts is unitarily made of synthetic-resin material.

10. A pants hanger comprising:
- a main part of synthetic-resin material having an upper portion and integral therewith a lower portion, and having a flat back side extending along said upper and lower portions;
- means for securing said main part with said back side against a vertical surface and with said upper portion above said lower portion, said means being provided at said upper and lower portions;
- a pivotal part of synthetic-resin material having an upper portion and integral therewith a lower portion respectively adjacent the upper and lower portions of said main part;
- a pivot having a horizontal pivot axis between said portions and interconnecting said parts, whereby said pivotal part can pivot about said axis relative to said main part;
- a spring braced between said parts and urging said lower portions toward each other;
- a horizontally extending ridge on each of said lower portions formed with a central pants seam-receiving notch and engageable against the corresponding ridge of the other lower portion; and
- a flat surface on each of said lower portions below the respective ridge inclined downwardly away from the other lower portion and forming with the flat surface of the other lower portion a downwardly widening V-shaped throat.

* * * * *